US012799563B2

(12) United States Patent
Li et al.

(10) Patent No.: US 12,799,563 B2
(45) Date of Patent: Nov. 17, 2026

(54) METHOD FOR RECOVERING LITHIUM FROM MOTHER LIQUOR AFTER LITHIUM CARBONATE PRECIPITATION REACTION

(71) Applicant: SUNRESIN NEW MATERIALS CO. LTD., Shaanxi (CN)

(72) Inventors: Suidang Li, Shaanxi (CN); Hudao Yan, Shaanxi (CN); Jia Yu, Shaanxi (CN); Lili Fan, Shaanxi (CN); Fumin Guo, Shaanxi (CN); Junlin Gao, Shaanxi (CN); Weiqiang Lyu, Shaanxi (CN); Yuyun Wei, Shaanxi (CN); Qiong Liu, Shaanxi (CN); Xiaokang Kou, Shaanxi (CN)

(73) Assignee: SUNRESIN NEW MATERIALS CO. LTD., Shaanxi (CN)

( * ) Notice: Subject to any disclaimer, the term of this patent is extended or adjusted under 35 U.S.C. 154(b) by 730 days.

(21) Appl. No.: 18/255,166

(22) PCT Filed: Dec. 9, 2021

(86) PCT No.: PCT/CN2021/136837
§ 371 (c)(1),
(2) Date: May 31, 2023

(87) PCT Pub. No.: WO2022/121989
PCT Pub. Date: Jun. 16, 2022

(65) Prior Publication Data

US 2024/0026494 A1 Jan. 25, 2024

(30) Foreign Application Priority Data

Dec. 9, 2020 (CN) ..... 202011451139.X

(51) Int. Cl.
*C22B 26/12* (2006.01)
*C22B 7/00* (2006.01)

(52) U.S. Cl.
CPC ..... *C22B 26/12* (2013.01); *C22B 7/006* (2013.01)

(58) Field of Classification Search
CPC ..... C22B 26/12; C22B 7/006; C22B 3/24; C22B 3/42; B01D 15/08; B01D 15/203;
(Continued)

(56) References Cited

U.S. PATENT DOCUMENTS 8,287,829 B2 * 10/2012 Harrison ..... C01B 35/063 423/422
2011/0200508 A1 8/2011 Harrison et al.
(Continued)

FOREIGN PATENT DOCUMENTS

CA 1113648 A 12/1981
CL 2011002230 A1 2/2012
(Continued)

OTHER PUBLICATIONS

English machine translation of CN 108893605 A (Year: 2018).*
(Continued)

*Primary Examiner* — Richard M Rump
*Assistant Examiner* — Abdul-Rahman Yusuf Waleed Smari
(74) *Attorney, Agent, or Firm* — Dinsmore & Shohl LLP

(57) ABSTRACT

A method for recovering lithium from a lithium precipitation mother liquor, the method using the following cycle steps including adsorption, displacement, desorption and transformation: a. mounting a lithium-sodium separation resin in a resin column, and adding the lithium precipitation mother liquor to the resin column for adsorption, wherein the adsorption rate can reach 90% or more; b. after adsorption, washing the resin with water, displacing the resin with a lithium-salt-containing solution to wash out residual sodium from the resin; c. after displacement, desorbing the resin by
(Continued)

means of an acid solution to obtain a solution with a high lithium content and a low sodium content, which solution has passed desorption criteria; and d. after desorption, carrying out reverse transformation on the resin by means of a transformation solution in order to ensure that no bubbles appear and then reduce the adsorption effect during the adsorption process. During the cycle, the lithium in the lithium precipitation mother liquor is separated from the solution with a high lithium-to-sodium ratio to obtain the solution with the high lithium-to-sodium ratio.

2 Claims, 2 Drawing Sheets

(58) Field of Classification Search
CPC ..... B01D 15/422; B01D 15/00; B01J 39/05; B01J 41/07; B01J 47/02; C01D 15/08; Y02P 10/20
See application file for complete search history.

(56) References Cited

U.S. PATENT DOCUMENTS

| | | | |
|---|---|---|---|
| 2011/0318253 | A1 | 12/2011 | Tiihonen |
| 2012/0107210 | A1 | 5/2012 | Harrison et al. |
| 2014/0334997 | A1 | 11/2014 | Ehren et al. |
| 2024/0026494 | A1 | 1/2024 | Li et al. |

FOREIGN PATENT DOCUMENTS

| | | | | | |
|---|---|---|---|---|---|
| CL | 2012002274 | A1 | | 6/2013 | |
| CN | 101928828 | B | | 12/2010 | |
| CN | 201825992 | U | | 5/2011 | |
| CN | 102249471 | B | | 11/2011 | |
| CN | 102348817 | A | | 2/2012 | |
| CN | 102703703 | B | | 10/2012 | |
| CN | 202595229 | U | | 12/2012 | |
| CN | 105797428 | A | * | 7/2016 | ..... B01D 15/361 |
| CN | 106076243 | B | | 11/2016 | |
| CN | 106882822 | A | | 6/2017 | |
| CN | 107138126 | A | | 9/2017 | |
| CN | 108421539 | B | | 8/2018 | |
| CN | 108893605 | A | | 11/2018 | |
| CN | 109317087 | B | | 2/2019 | |
| CN | 111533146 | A | | 8/2020 | |
| CN | 112717468 | A | | 4/2021 | |
| EP | 3594382 | A2 | | 1/2020 | |
| JP | 2019099874 | B1 | | 6/2019 | |
| WO | 2018223192 | A1 | | 12/2018 | |

OTHER PUBLICATIONS

English machine translation of CN 108421539 A (Year: 2018).*
English machine translation of JP 2019099874 A (Year: 2019).*
International Search Report and Written Opinion of Application No. PCT/CN2021/136837 Mailed Mar. 9, 2022, 15 pages.
Office Action of Corresponding Canadian Application No. 3199644 Dated Jun. 13, 2024, 3 pages.
First Office Action of Corresponding Chinese Application No. 202011451139.X Dated Dec. 23, 2021, 29 pages.
Second Office Action of Corresponding Chinese Application No. 202011451139.X Dated Aug. 26, 2022, 19 pages.
Decision of Rejection of Corresponding Chinese Application No. 202011451139.X Dated Jan. 28, 2023, 18 pages.
Extended European Search Report of Corresponding EP Application No. 21902694.5 Dated Mar. 15, 2024, 11 pages.
First Office Action of Corresponding Australian Application No. 2021395126 Dated Apr. 29, 2024, 3 pages.
Second Office Action of Corresponding CL Application No. 202301612 Dated Sep. 2, 2025.
First Office Action of Corresponding European Patent Application No. 21902694.5 dated Jun. 11, 2025, 5 pages.
First Office Action of Corresponding Chile Patent Application No. 202301612 dated Apr. 3, 2025, 24 pages.

* cited by examiner

METHOD FOR RECOVERING LITHIUM FROM MOTHER LIQUOR AFTER LITHIUM CARBONATE PRECIPITATION REACTION

TECHNICAL FIELD

The present invention relates to a method for recovering lithium from mother liquor after lithium carbonate precipitation reaction, which belongs to the field of hydrometallurgy. In particular, lithium is adsorbed from a mother liquor after lithium carbonate precipitation reaction using lithium-sodium separation resin. The saturated resin after the adsorption is then eluted with a lithium salt solution which has been used to wash sodium. A continuous ion-exchange device is used and operated in a cycle sequence of lithium ion adsorption, transformation, desorption and displacement.

BACKGROUND

Lithium is an important new energy material and there is a continuous increase in the demand of lithium in automotive, wind power, IT and other fields. Especially with the rapid growth of electric vehicle sales in China, the demand for lithium is also growing rapidly.

At present, lithium as a raw material for new energy batteries is mainly provided as lithium carbonate products. One of the main production methods of lithium carbonate is the ore method which comprises steps of calcining spodumene for transformation, sulfuric acid acidification roasting, leaching, removing impurities and evaporating to obtain a lithium sulfate solution rich of lithium. The lithium-rich solution reacts with excess sodium carbonate solution (10-30% more than the theoretical amount) to form lithium carbonate precipitates and a mother liquor (also called a mother liquor after lithium carbonate precipitation reaction, which has a lithium content of about 2.0-3.0 g/L, accounting for about 15-30% of a total weight of lithium, and also comprises a large amount of sodium carbonate and sodium sulfate). Another method is to separate and extract lithium from brine. Generally a brine is first adsorbed by a lithium adsorbent and then desorption is performed. The resulted solution is then passed through a membrane to remove impurities and get concentrated, and is further concentrated by evaporation to obtain a lithium-rich solution. Then lithium is precipitated by adding an excess of sodium carbonate solution (10-25% more than a corresponding mole amount) to obtain precipitated lithium carbonate products and a mother liquor (also called a mother liquor after lithium carbonate precipitation reaction, which has a lithium content of about 1.5-2.5 g/L, accounting for about 15-25% of a total weight of lithium contained in the lithium-rich solution before precipitation, and comprises a large amount of sodium carbonate and sodium chloride). Other production methods, such as recovering lithium from waste lithium batteries, also involve precipitation with sodium carbonate to obtain lithium carbonate products, generating a lithium carbonate mother liquor after precipitation.

In the prior technology, lithium is recovered from a mother liquor after lithium carbonate precipitation reaction mainly by the neutralization-evaporation-crystallization method. In detail, residual carbonate ions in the mother liquor after lithium carbonate precipitation reaction are neutralized with sulfuric acid, generating a mixed solution of sodium sulfate and lithium sulfate. Then the mixed solution is concentrated by evaporation and undergoes crystallization by cooling to form sodium sulfate solids, followed by filtration to obtain a lithium-rich (lithium sulfate) filtrate. Then sodium carbonate is added for precipitation reaction to produce lithium carbonate (commonly known as secondary lithium carbonate). Alternatively, in a sodium chloride system, sodium chloride is precipitated by natural evaporation and reused in the lithium precipitation process for recovery.

However, due to the high content of impurity ions like $Na^+$, $K^+$ in the mother liquor after lithium carbonate precipitation reaction, the secondary lithium carbonate product obtained by precipitation usually has a high content of impurity ions like $Na^+$, $K^+$ and other impurities, and thus cannot reach the national standard of battery grade lithium carbonate, but can only reach the national standard of industrial secondary lithium carbonate, the price of which is much lower than that of battery grade lithium carbonate (about 30-40% lower). At present, battery grade lithium carbonate manufacturers generally have to produce a certain amount of industrial secondary lithium carbonate products (accounting for about 20-30% of the total lithium product output), which reduces the economic benefits of lithium carbonate manufacturers. Therefore, how to reduce the production of secondary lithium carbonate products has become an urgent technical problem to be solved for lithium carbonate industry both in China and overseas.

CN106882822A proposes to recover lithium from a mother liquor after lithium carbonate precipitation reaction by a salt freezing crystallization method. The process is as follows: a mother liquor after lithium carbonate precipitation reaction is firstly frozen and undergoes crystallization. Sodium sulfate decahydrate (mirabilite) formed by crystallization is removed through refined filtration. The resulted is then concentrated by evaporation, and sodium carbonate is added to form lithium carbonate precipitation. The resulted is filtered to obtain a filter cake which is a crude product of lithium carbonate. The crude product is treated to remove sodium sulfate and washed repeatedly to obtain a high purity lithium carbonate. The filtered mother liquor is returned to the freezing crystallization section. However, this method has the following problems: a large amount of $Li^+$ is carried in the process of removing sodium sulfate by freezing crystallization, resulting in low lithium recovery rate. In addition, the freezing crystallization and refined filtration have a large circulation volume, high energy consumption and complex process, which greatly increases the production cost.

CN109317087A discloses a doped lithium titanate adsorbent and preparation method thereof. The adsorbent is a special adsorbent for extracting lithium from salt lake brines and shows excellent adsorption of lithium. The adsorbent is suitable for extracting lithium from salt lake brines with a high magnesium-to-lithium ratio, such as $Mg^{2+}/Li^+=100$ (mass ratio) and a low $Li^+$ content, generally 100-300 mg/L, and generally neutral or weakly alkaline. When using this adsorbent for extracting lithium from salt lake brines, the recovery rate of $Li^+$ is generally 70-80%. However, the mother liquor after lithium carbonate precipitation reaction is strongly alkaline and has a high concentration of lithium ions, so direct adsorption with the adsorbent can hardly achieve an economic efficient lithium recovery rate of 95% or more, resulting in a waste of large amount of lithium resources. Moreover, the cost of adsorbent should be considered and the dissolution loss rate should be controlled as low as possible when using adsorbent for the lithium adsorption from mother liquor after lithium carbonate precipitation reaction.

How to improve the recovery rate of lithium from the mother liquor after lithium carbonate precipitation reaction while reduce the content of impurities such as sodium and potassium in the obtained lithium-containing solution is a problem that needs to be solved in the prior technology.

SUMMARY OF THE INVENTION

In order to solve the above problems, the present invention provides a method for treating mother liquor after lithium carbonate precipitation reaction.

In one aspect, the present invention provides a method for recovering lithium from a mother liquor after lithium carbonate precipitation reaction, comprising cycling steps of adsorption, displacement, desorption and transformation, wherein:

step a. packing resin columns with a lithium-sodium separation resin disclosed in CN108421539A, and adding the mother liquor after lithium carbonate precipitation reaction into the resin columns to perform adsorption reaching an adsorption saturation rate of 90% or more;

step b. after adsorption, washing the resin with water, and carrying out displacement by washing the resin with a lithium solution as a sodium displacement solution to remove residual sodium from the resin;

step c. after displacement, carrying out desorption to desorb the resin with an acid solution, producing a qualified desorption solution with a high lithium and low sodium content; and step d. after desorption, carrying out reverse transformation in the resin by using a transformation solution in order to ensure that no bubbles appear and then maintain the adsorption effect during the adsorption process, wherein, during the cycling, lithium is separated from the mother liquor after lithium carbonate precipitation reaction which is a solution with a high sodium-to-lithium ratio, producing a solution with a high lithium-to-sodium ratio which is helpful for subsequent treatment.

Optionally, the mother liquor after lithium carbonate precipitation reaction is a mother liquor obtained by filtration after precipitation of a salt solution of lithium with sodium carbonate in a process of preparing lithium carbonate.

Optionally, the sodium displacement solution is a lithium solution which is selected from the group consisting of lithium sulfate solution, lithium chloride solution, lithium carbonate solution, and lithium hydroxide solution, and any mixture of two thereof.

Optionally, the transformation solution is made from the sodium displacement solution or a solution of an alkaline sodium salt such as sodium carbonate or sodium hydroxide.

Optionally, the mother liquor after lithium carbonate precipitation reaction has a pH of 9 or more to ensure the adsorption effect.

Optionally, the acid solution used in said desorption is a sulfuric acid solution or a hydrochloric acid solution and has a concentration of 0.1-36% by weight.

Optionally, the acid solution used in said desorption has a concentration of 4-15% by weight.

Optionally, the acid solution used in said desorption has a preferred concentration of 6-10% by weight.

Optionally, the cycling steps of adsorption, displacement, desorption and transformation are performed by using a continuous ion-exchange device described in CN108893605A; The "lithium ion adsorption section (i.e., lithium-sodium separation section), rinse section, desorption section, backwashing section and brine pushing section which are arranged in sequential movement and circulation operation to treat lithium-sodium solution" described in CN108893605A are rearranged into a lithium ion adsorption section, displacement section, desorption section and transformation section; wherein the transformation section is operated by using an effluent from the displacement section, constituting an internal circulation. The method achieves an adsorption efficiency of 90% or more, and the qualified desorption solution has a lithium ion content of 7 g/L or more, preferable 10 g/L, and a lithium-sodium ratio of 2 or more, preferable 10. The lithium ion adsorption section comprises 4 resin columns arranged in series connection and running in a backward feeding mode; the displacement section comprises 3 resin columns arranged in series connection and running in a forward feeding mode; the desorption section comprises 4 resin column arranged in series connection and running in a forward feeding mode; and the transformation section comprises 2 resin columns arranged in series connection and running in a backward feeding mode. The method is carried out by using a multi-way valve device, comprising packing a resin column of the multi-way valve with the lithium-sodium separation resin and performing the above mentioned steps; wherein a saturated lithium carbonate solution is used as the lithium-salt-containing solution in the displacement section; an effluent discharged from the displacement section is used as a feed for the transformation section to ensure that no bubbles appear and then maintain the adsorption effect during the adsorption process, thereby ensuring the device has a high adsorption rate; and wherein the desorption is carried out by using 8% hydrochloric acid solution.

The lithium-sodium separation resin material used in present invention is disclosed in CN108421539A. The lithium adsorption material provided in CN108421539A is an organic macromolecule cross-linking polymer which has a stable structure and is grafted with a special functional group, and wherein the functional group is at least one selected from the group consisting of the following:

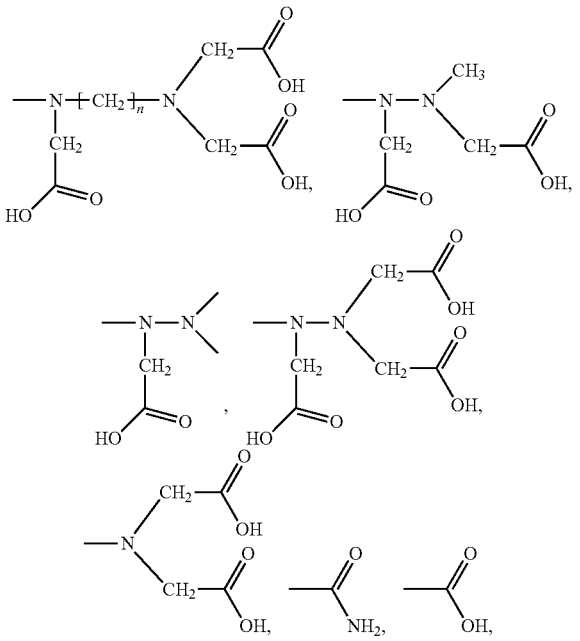

-continued

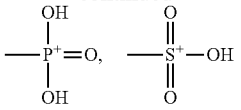

Such resin is used in present application and capable of selectively adsorbing lithium ions in a high sodium environment to achieve lithium-sodium separation. The specific steps are as follows: 1. Resin exchange columns are packed with the lithium-sodium separation resin, and a mother liquor after lithium carbonate precipitation reaction is passed through the resin column at a certain flow rate; 2. The resin is washed with water after the resin is saturated to completely remove the mother liquor from the resin; and then displacement is carried out with a lithium solution to push out residual sodium from the resin, thereby further separating the residual sodium from the resin; 3. Desorption is carried out to desorb the resin with a certain concentration of hydrochloric acid solution or sulfuric acid solution; and then the resin is washed with water for removing the residual acid from the resin; 4, After desorption, reverse transformation on the resin is carried out by using a transformation solution in order to ensure that no bubbles appear and then maintain the adsorption effect during the adsorption process.

The inventors have found that during the use of this resin, when the lithium-sodium containing solution entering the resin column has a pH of 7 or more, the performance of the resin in adsorption of lithium is improved and lithium can be separated from sodium more effectively. When the pH is 9 or more, the separation performance is even better, and the separation performance is optimal when the pH is between 10 and 12. However, there will be more residual sodium in the resin, and if the desorption is carried out directly, the solution after desorption will has a sodium-lithium ratio of 2 or more. Although the sodium-lithium ratio has decreased significantly, from 20 or more to a range of 2 to 10, it will still cause trouble for the subsequent process sections. On the one hand, the sodium salt contained therein will precipitate out and block the evaporator when concentration is carried out, and on the other hand, a large amount of sodium will be brought into the lithium carbonate products when lithium precipitation operation is carried out, resulting in more impurities and lower product yields. To solve this problem, the inventors treat the resin again with a lithium-salt-containing solution for removing sodium from the resin. The lithium salt used here is selected from the group consisting of lithium sulfate, lithium chloride, lithium carbonate, lithium hydroxide, lithium nitrate, and any mixture thereof.

Desorption is carried out with a commonly used acid solution such as a sulfuric acid solution or a hydrochloric acid solution, and the resulted solution after the desorption mainly contains lithium sulfate, sodium sulfate or lithium chloride and sodium chloride, all of which have good solubility in water. Subsequent processes to produce lithium carbonate products are very mature in prior technology. The hydrochloric acid or sulfuric acid solution used in present invention has a concentration of 0.1-36% or more by weight. But in practical use, the preferable concentration is 4~15%, and the more preferable concentration is 6~10%. On the one hand such concentration can guarantee small acid loss, reduce the amount of water for acid washing and save cost; and on the other hand can guarantee a high lithium ion content of 7 g/L or more, preferable 10 g/L, in the qualified desorption solution, thus reducing the cost of subsequent evaporation concentration operation.

After desorption, the resin contains functional groups including anionic and cationic groups (such as nitrogen containing cationic groups, carboxylic acid group, phosphoric acid group, sulfonic acid group, etc.), and thus hydrogen ions and anions such as sulfate ions and chloride ions will remain on the resin. If the next cycle of adsorption is carried out directly, the hydrogen ions on the resin will react with carbonic acid ions to release carbon dioxide, causing disturbance in the resin bed, which is not conducive to adsorption. In order to solve this problem, the inventors first carry out transformation on the resin with a solution of an alkaline sodium salt such as sodium carbonate or sodium hydroxide, etc., discharged from the displacement section, to consume part of the large amount of hydrogen ions inside the resin; In addition, according to the upward movement characteristic of gas, the invention adopts a backward feeding mode to bring the gas out of the resin column in the liquid flow direction. And the resin column outlet is connected by a separate pipeline to a buffer tank where the gas is released. The pure carbon dioxide gas can be collected from the buffer tank for further use.

In the process of verifying the above method, the inventors find that combining the device with a continuous ion-exchange device can realize better lithium-sodium separation performance, and the qualified desorption solution has a sodium-lithium ratio reduced to less than 1 or even less than 0.2 compared to more than 20:1 in the original solution. A typical qualified desorption solution has a sodium content of 1 g/L or less when the lithium content is 10 g/L, and has a pH value of about 8 and can be discharged stably. Common continuous ion-exchange devices can meet the demand. For example, the continuous ion-exchange device disclosed in CN108893605A can be used. When the device of CN108893605A is adopted to carry out the lithium-sodium separation in the present application, we rearrange "lithium adsorption section, rinse section, desorption section, backwashing section and brine pushing section which are arranged in sequential movement and circulation operation to treat lithium-sodium mixed solution" described in CN108893605A into a lithium ion adsorption section, displacement section, desorption section and transformation section; wherein the transformation section is operated by using an effluent from the displacement section, constituting an internal circulation. The details are as follows:

The lithium ion adsorption section comprises a plurality of resin columns arranged in series connection. The mother liquor obtained after carbonate lithium precipitation is passed through the resin columns to produce an effluent which is a pure solution containing only sodium chloride. The effluent can be concentrated by evaporation in the sun to give sodium chloride products.

The displacement section works to displace sodium adsorbed by resin with a lithium solution. The lithium salt used herein comprises but is not limited to lithium chloride, lithium sulfate, lithium carbonate, lithium hydroxide, etc. The lithium solution has a lithium concentration of 0.1 g/L or more, preferably 1-20 g/L, and more preferably 2-6 g/L. The concentration depends on the actual situation, provided that good economic benefits can be achieved.

The desorption section works to desorb the lithium adsorbed by resin with an acid, so that the desorbed lithium can be precipitated in the subsequent lithium carbonate precipitation process. The desorption is performed using an acid solution. The desorption section comprises a plurality of resin columns arranged in series connection. The qualified desorption solution has a high lithium concentration which can reach 7 g/L, preferably 10 g/L.

Since the resin is desorbed with an acid, hydrogen ions dominated the material in the resin columns after the desorption. The purpose of transformation section is to neutralize some hydrogen ions so that least gas will be generated during the adsorption process and maintain the adsorption effect. The transformation section is operated by using an effluent from the displacement section.

Through the above combination, lithium ions are recovered from a mother liquor after lithium carbonate precipitation reaction by adsorption method, and then adsorption efficiency can reach 90% or more. The qualified desorption solution has a lithium ion content of 7 g/L or more and a lithium-sodium ratio of 1 or more. The running is stable.

In the present application the materials described in CN108421539A is used in combination with the continuous ion-exchange device described in CN108893605A, and a good lithium-sodium separation of mother liquor after lithium carbonate precipitation reaction is realized, which is feasible in industrialization and has good economic benefits. By the method of the present application, the above mentioned effects can be achieved as long as the mother liquor after lithium carbonate precipitation reaction has a pH of 9 or more. Generally an excess of sodium carbonate is usually added in the lithium precipitation section to improve the yield of lithium, and thus the pH of the solution is generally kept at about 10, which facilitates the method of the present application. At the same time, regeneration is performed using common used acids, which has obvious cost advantage. The technology of the present application solves the technical problems such as difficult lithium-sodium separation, low yield and high sodium and potassium impurities in the prior technology. At the same time, there are only sodium ions and lithium ions in the lithium precipitation mother solution, without introduction of magnetic substances, calcium and magnesium. Thus the qualified desorption solution has a high purity. After precipitation in the lithium precipitation section, the products are lithium carbonates of battery grade, having the performance of high-purity battery grade lithium carbonate.

The continuous ion-exchange device of CN108893605A comprises a resin, resin columns for loading resin, a feeding main pipe connected with an upper end of the resin column and a discharging main pipe connected with a lower end of the resin column. The resin columns are divided into five sections, each section comprises at least one resin column, and the resin columns are arranged in series connection via pipelines to form a lithium sodium separation section, rinse section, desorption section, backwashing section and brine pushing section which are arranged in sequential movement and circulation operation. Optionally, the lithium-sodium separation section comprises a first resin column (13), a second resin column (14) and a third resin column (15) which are connected in series via pipeline (43). An upper end of the first resin column (13) in the lithium-sodium separation section is provided with a feeding inlet (3) for the lithium-sodium separation section, and a lower end of the third resin column (15) in the lithium-sodium separation section is provided with a discharging outlet (4) for the lithium-sodium separation section. Optionally, the rinse section comprises a first resin column (11) and a second resin column (12) which are connected in series via pipeline (43). An upper end of the first resin column (11) in the rinse section is provided with a feeding inlet (1) for the rinse section, and a lower end of the second resin column (12) in the rinse section is provided with a discharging outlet (2) for the rinse section. Optionally, the desorption section comprises a first resin column (18), a second resin column (19) and a third resin column (20) which are connected in series via pipeline (43). An upper end of the first resin column (18) in the desorption section is provided with a feeding inlet (9) for the desorption section, and a lower end of the third resin column (20) in the desorption section is provided with a discharging outlet (10) for the desorption section. Optionally, the backwashing section comprises a resin column (17), wherein, a lower end of the resin column 17 in the backwashing section is provided with a feeding inlet (7) for the backwashing section, and a upper end of the resin column (17) in the backwashing section is provided with a discharging outlet (8) for the backwashing section. Optionally, the brine pushing section comprises a resin column (16), wherein a lower end of the resin column (16) in the brine pushing section is provided with a feeding inlet (5) for the brine pushing section, and an upper end of the resin column (16) in the brine pushing section is provided with a discharging outlet (6) for the brine pushing section. Optionally, the feeding main pipe comprises a feeding main pipe (35) for lithium-sodium separation, a feeding main pipe (34) for rinsing, a feeding main pipe (33) for desorption, a feeding main pipe (37) for backwashing and a feeding main pipe (36) for feed pushing back water, and the discharging main pipe comprises a discharging main pipe (40) for lithium-sodium separation, a discharging main pipe (39) for rinsing, a discharging main pipe (38) for desorption, a discharging main pipe (42) for backwashing and a discharging main pipe (41) for feed pushing back water. Each resin column is respectively provided with a feeding branch pipe connected with the feeding main pipe and a discharging branch pipe connected with the discharging main pipe. Optionally, the feeding branch pipe comprises a feeding branch pipe (23) for lithium-sodium separation, a feeding branch pipe (22) for rinsing, a feeding branch pipe (21) for desorption, a feeding branch pipe (25) for backwashing and a feeding branch pipe (24) for feed pushing back water, which are respectively connected with the feeding main pipe (35) for lithium-sodium separation, the feeding main pipe (34) for rinsing, the feeding main pipe (33) for desorption, the feeding main pipe (37) for backwashing and the feeding main pipe (36) for feed pushing back water. Optionally, the discharging branch pipe comprises a lithium sodium separation discharging branch pipe (28), a discharging branch pipe (27) for rinsing, a discharging branch pipe (26) for desorption, a discharging branch pipe (30) for backwashing and a discharging branch pipe (29) for feed pushing back water, which are respectively connected with the discharging main pipe (40) for lithium-sodium separation, the discharging main pipe (39) for rinsing, the discharging main pipe (38) for desorption, the discharging main pipe (42) for backwashing and the discharging main pipe (41) for feed pushing back water. Optionally, each of the feeding branch pipes, the discharging branch pipes and pipelines for series connection is provided with a control valve (31) to periodically control the resin column sections to realize the synchronization of lithium-sodium separation, rinsing, desorption, backwashing and feed pushing back water processes. Optionally, the control valve (31) is a solenoid valve or a pneumatic valve, which is controlled by a PLC program to periodically control the opening and closing of the feeding branch pipes, the discharging branch pipes and the pipelines for series connection. Optionally, the resin is a special resin for lithium-sodium separation with a macroporous structure.

Figure 1:
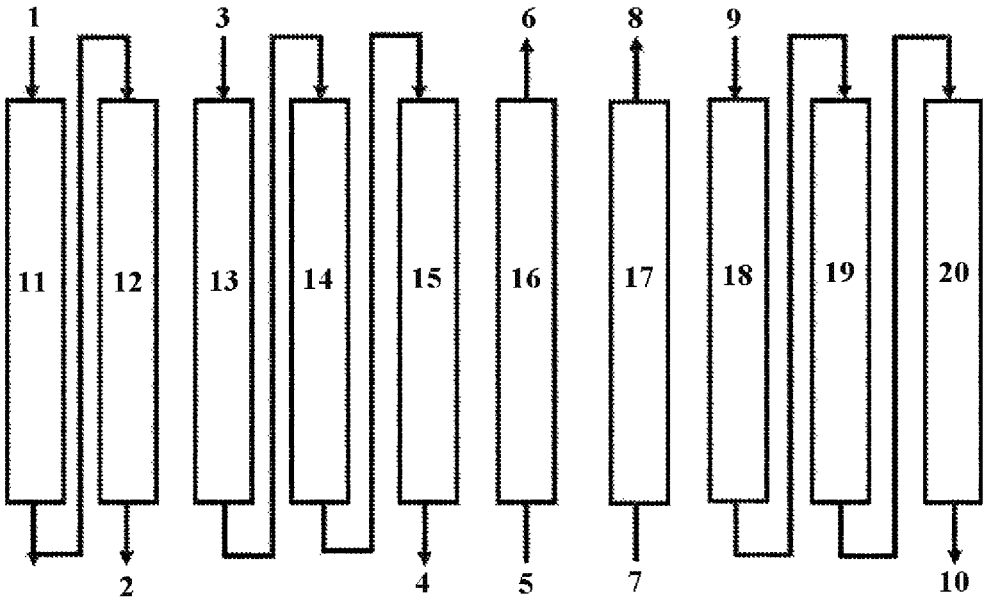
FIG. 1 shows a schematic diagram of process flow of the continuous ion-exchange method of CN108893605A as described in Example 2 of the present application.
Figure 2:
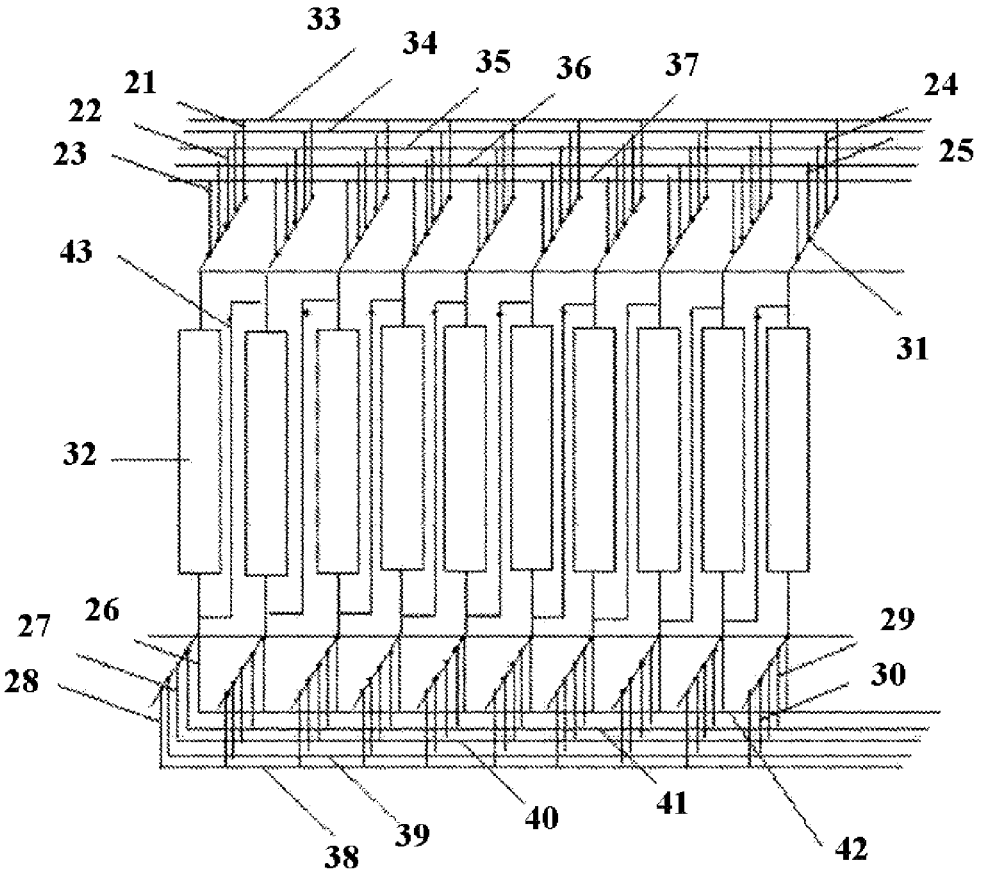
FIG. 2 shows a schematic diagram of the device for the continuous ion exchange method of FIG. 1.

Wherein:

1. feeding inlet of rinse section; 2. discharging outlet of rinse section; 3. feeding inlet of lithium-sodium separation section; 4. discharging outlet of lithium-sodium separation section; 5. feeding inlet of brine pushing section; 6. discharging outlet of brine pushing section; 7. feeding inlet of backwashing section; 8. discharging outlet of backwashing section; 9. feeding inlet of desorption section; 10. discharging outlet of desorption section; 11. the first resin column of rinse section; 12. the second resin column of rinse section; 13. the first resin column of lithium-sodium separation section; 14. the second resin column of lithium-sodium separation section; 15. the third resin column of lithium-sodium separation section; 16. resin column of brine pushing section; 17. resin column of backwashing section; 18. the first resin column of desorption section; 19. the second resin column of desorption section; 20. the third resin column of desorption section; 21. feeding branch pipe for desorption; 22. feeding branch pipe for rinsing; 23. feeding branch pipe for feed liquid; 24. feeding branch pipe for feed pushing back water; 25. feeding branch pipe for backwashing; 26. discharging branch pipe for desorption; 27. discharging branch pipe for rinsing; 28. discharging branch pipe for feed liquid; 29. discharging branch pipe for feed pushing back water; 30. discharging branch pipe for backwashing; 31. control valve; 32. resin column; 33. feeding main pipe for desorption 34. feeding main pipe for rinsing; 35. feeding main pipe for brine; 36. feeding main pipe for feed pushing back water; 37. feeding main pipe for backwashing; 38. discharging main pipe for desorption; 39. discharging main pipe for rinsing; 40. discharging main pipe for feed liquid; 41. discharging main pipe for feed pushing back water; 42. discharging main pipe for backwashing; 43. pipeline for series connection.

DETAILED DESCRIPTION OF THE EMBODIMENTS

The present application will be further illustrated with reference to following embodiments. However, these embodiments are only for illustrating, rather than limitations to the present invention detailed in the claims.

The invention provides a method for recovering lithium from a mother liquor after lithium carbonate precipitation reaction. The method of present application can realize the recovery of lithium from sodium carbonate mother liquor after lithium carbonate precipitation reaction which has a high sodium content and low lithium content, with a recovery rate of 90% or more. At the same time, the qualified desorption solution has a lithium-sodium ratio of 1 or more, so as to ensure the production of battery grade lithium carbonate in the subsequent process.

In order to further explain the present patent, some examples are described to further explain the use of present invention.

Example 1: Lithium-Sodium Separation Experiment in Fixed Bed Mode 100 ml lithium-sodium separation resin is measured using a measuring cylinder (The resin is prepared according to the formula in Example 1 of CN108421539A through polymerization and aminomethylation. The polymerization is performed as follows: 40 g of 63% divinylbenzene, 380 g styrene, 210 g paraffin oil and 4.2 g BPO are added to a 2 L dry beaker, stirred and mixed well to prepare an oil phase. 2.5 L tap water is added to a 5 L three-necked flask, and 25 g of 0.5% carboxymethyl cellulose aqueous solution is added thereto, stirred, and heated to 40 °C to prepare an aqueous phase. The oil phase is poured into the three-necked flask, allowed to stand for 10 min, and then stirred to make the oil phase dispersed well in the form of beads. Adjust the stirring speed to make the beads have a diameter of about 0.7 mm. Keep this stirring speed, and heat up to 70 °C and hold for 2 h, then heat up to 85 °C within 2 h and hold for 3 h, and heat up to 90 °C within 2 h and hold for 2 h, then cool down and separate resin particles. Wash the resin particles with water, and extract the white oil in channels of the resin with dimethoxymethane, and wash with water to obtain polymer spheres. Aminomethylation is carried out by the method described in patent CN104231141B as follows: The obtained aminomethyl resin is dried at 80 °C to a water content of 1% or lower. 100 g of the dried aminomethyl resin is weighed and added to a dried 1 L three-necked flask, 100 ml of methanol is added, and then 400 ml of methyl acetate is added, and stirred at room temperature for 120 min. Thereafter, 5 g of sodium methanol is added. Heat to reflux state and react for 10 h. Cool down, and filter out and recover the solution. The resin is washed with methanol and then washed with water until methanol cannot be smelled, obtaining finished acetamide resin products. The resin can be used for lithium-sodium separation, and is recorded as lithium adsorbent material 1). The resin is packed in a resin column, and treated with 200 ml of 4% hydrochloric acid solution, and then washed with water until the outlet of the resin column reaches pH>2. The water in the resin column is drained. Reverse transformation of the resin is carried out with a sodium hydroxide solution having a concentration of 1% by weight, 400 ml in total. After the transformation is completed, a mother liquor after lithium carbonate precipitation reaction is fed in a backward mode to the resin column to undergo adsorption. A barren liquor is collected to measure the lithium content at the outlet. The adsorption is suspended when liquids at the inlet and outlet of the adsorption section have the same lithium content. 200 ml water is fed in a forward mode to wash out the mother liquor. The resin column is then washed with 400 ml of a lithium chloride solution having a concentration of 1% by weight to wash out sodium. Then the resin is washed with water to recover the lithium. Desorption is carried out by using a hydrochloric acid solution having a concentration of 8% by weight. The data of the qualified desorption solution are listed in the following table.

| Bed Volume(BV) | Lithium g/L | Sodium g/L | pH |
|---|---|---|---|
| 0.3 | 1.7 | 2.5 | 10.88 |
| 0.6 | 3.3 | 0.86 | 2.28 |
| 0.9 | 9.2 | 0.93 | 0.79 |
| 1.2 | 13.9 | 1.61 | 0.93 |
| 1.5 | 9.2 | 0.52 | 0.08 |
| 1.8 | 2.2 | 0.1 | 0.02 |
| 2.1 | 0.6 | 0.1 | 0.02 |

It can be seen from the data that the qualified desorption solution has a maximum lithium content of 13 g/L, and a maximum lithium-sodium ratio close to about 20, indicating the process is very effective.

Example 2 Lithium-Sodium Separation with Continuous Ion-Exchange Device

According to the method described in Example 1 of CN108893605A, the details are as follows: as shown in Table 1, the continuous ion-exchange extraction process for lithium-sodium separation uses a continuous ion-exchange device to separate lithium chloride from a lithium-sodium containing solution and adopts a continuous operation mode in a series connection.

(Numbers Represent Different Resin Columns)

TABLE 1

Step by step operation of resin columns with different functions in different zones

| Step No. | Rinse section | | Adsorption section for removing boron | | | Brine pushing section | Back washing section | Desorption section | | |
|---|---|---|---|---|---|---|---|---|---|---|
| 1 | 11 | 12 | 13 | 14 | 15 | 16 | 17 | 18 | 19 | 20 |
| 2 | 12 | 13 | 14 | 15 | 16 | 17 | 18 | 19 | 20 | 21 |
| 3 | 13 | 14 | 15 | 16 | 17 | 18 | 19 | 20 | 11 | 12 |
| 4 | 14 | 15 | 16 | 17 | 18 | 19 | 20 | 11 | 12 | 13 |
| 5 | 15 | 16 | 17 | 18 | 19 | 20 | 11 | 12 | 13 | 14 |
| 6 | 16 | 17 | 18 | 19 | 20 | 11 | 12 | 13 | 14 | 15 |
| 7 | 17 | 18 | 19 | 20 | 11 | 12 | 13 | 14 | 15 | 16 |
| 8 | 18 | 19 | 20 | 11 | 12 | 13 | 14 | 15 | 16 | 17 |
| 9 | 19 | 20 | 11 | 12 | 13 | 14 | 15 | 16 | 17 | 18 |
| 10 | 20 | 11 | 12 | 13 | 14 | 15 | 16 | 17 | 18 | 19 |
| 11 | 11 | 12 | 13 | 14 | 15 | 16 | 17 | 18 | 19 | 20 |
| . . . | | | | | | etc. | | | | |

The method disclosed in Example 1 of CN108893605A comprises the following steps:

The resin column is packed with the special resin for lithium-sodium separation (SUNRESIN NEW MATERIALS CO. LTD.), and the feed liquid has a content of lithium ion of 1.7 g/L.

As shown in Table 1, each resin column is in the following different resin column sections, taking step No. 1 as an example:

1 # and 2 # columns: desorption section

3 # column: rinse section

4 #, 5 # and 6 # columns: lithium-sodium separation section

7 #, 8 # columns: brine pushing section

9 # and 10 # columns: backwashing section

The 4 #, 5 # and 6 # columns in the lithium-sodium separation section are connected in series and operated in a forward feeding mode. The feed liquid from the feeding main pipe enters the feeding branch pipe at the upper port of the 4 # column, passes through the 5 # column and the 6 # column successively through the series connection pipeline, and finally discharge from the discharging branch pipe at the lower port of the 6 # column to enter the brine discharging main pipe, and finally enters the product tank. During the whole adsorption process, the feed liquid is adsorbed and separated by three levels of resins and the concentration of lithium chloride gradually decreases. The resin is saturated when the concentration of lithium chloride at the lower port of 4 # column is consistent with that at the inlet. Then the 4 # column is switched via an valve to the rinse section. Feed speed: 2 BV/h, the total amount of feed: 2 BV, recovery rate of lithium chloride: 96.7%, retention time: 60 min.

3 # column: rinse section. Deionized water from feeding main pipe for rinsing enters the feeding branch pipe for rinsing connected with the upper port of 3 # column, and discharge form the discharging branch pipe for rinsing at the lower port to enter the discharging main pipe for rinsing, and then returns to a salt bath to remove the feed liquid remaining in the resin to the greatest extent. The rate of deionized water is 2 BV/h, the total amount of feed is 2 BV, the retention time is 60 min, and the rinsing solution at the outlet has a lithium chloride ion content of 3 ppm. After the process is completed, the resin is in a waiting state.

1 # and 2 # columns: desorption section. A large amount of lithium chloride is adsorbed on the resin after rinsing. 4% hydrochloric acid solution from the desorption feeding main pipe enters the desorption feeding branch pipe connected with the upper port of 1 # column, passes through 1 # column, enters the upper port of 2 # column through the series connection pipeline, and is discharged after passing through 2 # column. The rate of hydrochloric acid solution is 1.5 BV/h, the total amount is 1 BV, and the retention time is 60 min.

9 # and 10 # columns: backwashing section. Deionized water from the backwashing solution main pipe flows through the branch pipe and enters the 9 # resin column from the lower part thereof, and then passes through the series connection pipeline to enter the 10 # resin column from the lower part thereof, and is discharged. The rate of backwashing: 10 BV/h, total amount: 5 BV, retention time: 30 min.

7 # and 8 # columns: brine pushing section. The liquid discharged from the adsorption zone where lithium-sodium separation is performed flows through the main pipe for feed pushing back water and the branch pipe to enter the 7 # resin column from the lower part thereof, and then flows through the series connection pipeline to enter the 8 # resin column from the lower part thereof, and is discharged. The residual water in the resin column can be pushed out and can be reused as rinsing solution. The rate of brine: 5 BV/h, total amount: 3 BV, retention time: 36 min.

When the first cycle is completed, the resin columns in each section are controlled by an valve via PLC program, so that each resin column section is switched successively to complete the next cycle.

According to the method in Example 1 of CN108893605A, "lithium adsorption section, rinse section, desorption section, backwashing section and brine pushing section which are arranged in sequential movement and circulation operation to treat lithium-sodium solution" are rearranged in the present invention into "a lithium adsorption section, displacement section, desorption section and transformation section", wherein the lithium adsorption section comprises 4 resin columns arranged in series connection and running in a backward feeding mode; the displacement section comprises 3 resin columns arranged in series connection and running in a forward feeding mode; the desorption section comprises 4 resin column arranged in series connection and running in a forward feeding mode; the transformation section comprises 2 resin columns arranged in series connection and running in a backward feeding mode. The experiment is carried out by using a multi-way valve device, comprising packing a resin column of the multi-way valve with the lithium-sodium separation resin and performing the above mentioned steps; wherein a saturated lithium carbonate solution is used as the lithium-salt-containing solution in the displacement section; an effluent discharged from the displacement section is used a feed for the transformation section to ensure that no bubbles appear and maintain the adsorption effect during the adsorption process, thereby ensuring the device has a high adsorption rate; and wherein the desorption is carried out by using a hydrochloric acid solution having a concentration of 8 by weight. The data are shown in the following table:

| Number of cycles | Solution | Lithium concentration g/L | Sodium concentration g/L | pH |
|---|---|---|---|---|
| | Original solution | 1.7 | 36.4 | 11.3 |
| 1 | Barren solution | 0.087 | | |
| | Qualified desorption solution | 9.37 | 0.16 | 7.6 |
| 2 | Barren solution | 0.091 | | |
| | Qualified desorption solution | 8.76 | 0.4 | 7.7 |
| 3 | Barren solution | 0.082 | | |
| | Qualified desorption solution | 8.64 | 0.34 | 7.2 |
| 4 | Barren solution | 0.095 | | |
| | Qualified desorption solution | 9.76 | 0.423 | 7.9 |
| 5 | Barren solution | 0.082 | | |
| | Qualified desorption solution | 7.77 | 0.28 | 7.6 |
| 6 | Barren solution | 0.087 | | |
| | Qualified desorption solution | 8.64 | 0.56 | 7.3 |
| 7 | Barren solution | 0.079 | | |
| | Qualified desorption solution | 8.45 | 0.43 | 7.6 |
| 8 | Barren solution | 0.085 | | |
| | Qualified desorption solution | 8.29 | 0.43 | 7.4 |
| 9 | Barren solution | 0.088 | | |
| | Qualified desorption solution | 8.47 | 0.61 | 7.6 |
| 10 | Barren solution | 0.083 | | |
| | Qualified desorption solution | 8.37 | 0.52 | 7.8 |

From the operation data it can be seen that, the adsorption rate of the system is 90% or more, the qualified desorption solution has a lithium-sodium ratio of 10 or more, a pH value of neutral and slightly alkaline. The overall operation is stable, the lithium-sodium separation effect is stable, and the lithium-sodium ratio in the original solution can be increased from 0.046 to 10 and the operation is stable.

The embodiments of the invention are only intended to show the effect of the invention, not to limit the invention, but to supplement the invention.

We claim:

1. A method for recovering lithium from a mother liquor after lithium carbonate precipitation reaction, comprising cycling steps of adsorption, displacement, desorption and transformation, the cycling steps comprising:

step a. packing resin columns with a lithium-sodium separation resin, and adding a mother liquor after lithium carbonate precipitation reaction into the resin columns to perform adsorption reaching an adsorption efficiency of 90% or more;

step b. after adsorption, washing the resin with water, and carrying out displacement by washing the resin with a lithium-salt-containing solution as a sodium displacement solution to remove residual sodium from the resin;

step c. after displacement, carrying out desorption to desorb the resin with an acid solution, producing a qualified desorption solution with a high lithium content and a low sodium content; and step d. after desorption, carrying out reverse transformation on the resin by using a transformation solution in order to ensure that no bubbles appear during the adsorption process, wherein, lithium is separated from the mother liquor after lithium carbonate precipitation reaction, the lithium-sodium separation resin is an organic macromolecule cross-linking polymer grafted with a functional group, and wherein the functional group is at least one selected from the group consisting of the following:

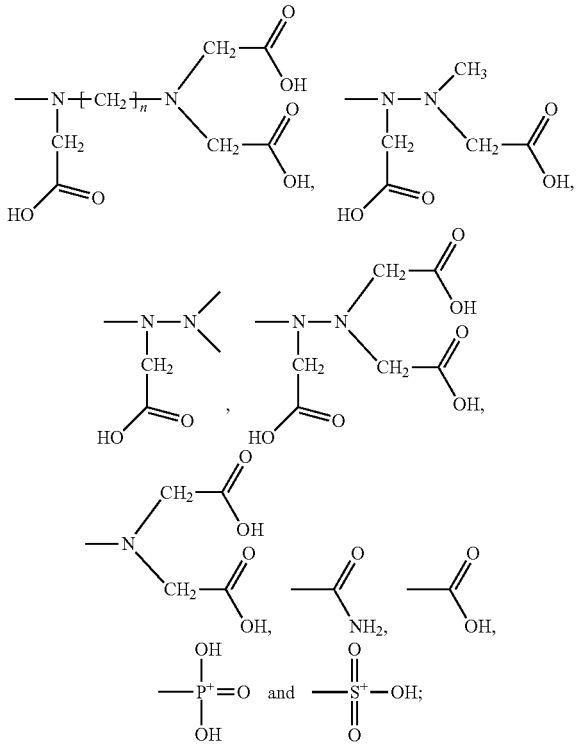

the mother liquor after lithium carbonate precipitation reaction is obtained by filtration after precipitation of a salt solution of lithium with sodium carbonate in a process of preparing lithium carbonate, the mother liquor after lithium carbonate precipitation reaction has a pH of 9 or more;

the cycling steps of adsorption, displacement, desorption and transformation are performed by using a continuous ion-exchange device, which comprises a lithium ion adsorption section, displacement section, desorption section and transformation section; wherein the transformation section is operated by using an effluent discharged from the displacement section, constituting an internal circulation;

wherein the method achieves an adsorption efficiency of 90% or more, and the qualified desorption solution has a lithium content of 7 g/L or more, and a lithium-sodium ratio of 2 or more, wherein the lithium adsorption section comprises 4 resin columns arranged in series connection and running in a backward feeding mode; the displacement section comprises 3 resin columns arranged in series connection and running in a forward feeding mode; the desorption section comprises 4 resin columns arranged in series connection and running in a forward feeding mode; the transformation section comprises 2 resin columns arranged in series connection and running in a backward feeding mode;

wherein the method is carried out by using a multi-way valve device, comprising packing resin columns of the multi-way valve device with the lithium-sodium separation resin and performing the steps (a) to (d); wherein a saturated lithium carbonate solution is used as the lithium-salt-containing solution in the displacement section; the effluent discharged from the displacement section is used as a feed for the transformation section to ensure that no bubbles appear during the adsorption process, thereby ensuring the continuous ion-exchange device has an adsorption efficiency of 90% or more; and wherein the desorption is carried out by using 8% hydrochloric acid solution; and the transformation solution is from sodium displacement solution or sodium carbonate or sodium hydroxide.

2. The method according to claim 1, wherein the qualified desorption solution has a lithium content of 10 g/L and a lithium-sodium ratio of 10.

* * * * *